US006449818B1

(12) United States Patent
Fildan et al.

(10) Patent No.: US 6,449,818 B1
(45) Date of Patent: Sep. 17, 2002

(54) GARMENT LINK

(75) Inventors: Gerhard Fildan, Vienna; Karl Wanzenböck, Leobersdorf, both of (AT)

(73) Assignee: Fildan Accessories Corporation, Humble, TX (US)

( * ) Notice: Subject to any disclaimer, the term of this patent is extended or adjusted under 35 U.S.C. 154(b) by 0 days.

(21) Appl. No.: 09/727,805

(22) Filed: Nov. 30, 2000

(51) Int. Cl.[7] ..... A44B 17/00

(52) U.S. Cl. ..... 24/578.1; 24/574.1; 24/580.1; 24/590.1; 24/662; 2/265; 63/3; 63/1.11; 450/86

(58) Field of Search ..... 24/305, 163 K, 24/574.1, 578.12, 581.1, 619, 578.1, 329, 662, 580.1, 590.1; 63/3, 1.11; 2/265, 270, 321, 322, 258; 450/78, 82, 86

(56) References Cited

U.S. PATENT DOCUMENTS 3,784,102 A * 1/1974 Stults ..... 239/36
4,109,787 A * 8/1978 Klygis et al. ..... 206/150
4,159,631 A * 7/1979 Lee ..... 239/36
4,982,480 A * 1/1991 Kasai ..... 24/104
5,102,023 A * 4/1992 Nguyen ..... 224/152
5,261,257 A * 11/1993 Collier ..... 24/576.1
5,520,036 A * 5/1996 Collier ..... 24/576.1

FOREIGN PATENT DOCUMENTS

GB 22243760 * 11/1991 ..... 63/18

* cited by examiner

*Primary Examiner*—Robert J. Sandy
*Assistant Examiner*—André Jackson
(74) *Attorney, Agent, or Firm*—Herbert Dubno

(57) ABSTRACT

A link having snap-fitted parts is provided with selected stones having different appearances to render the link highly versatile. The garment link, for brassieres, lingerie and the like, can use a perfume stone with laser-perforated capillaries communicating with a cavity from which scent may be released and which serves to draw a perfume liquid into the cavity.

8 Claims, 9 Drawing Sheets

FIG. 3
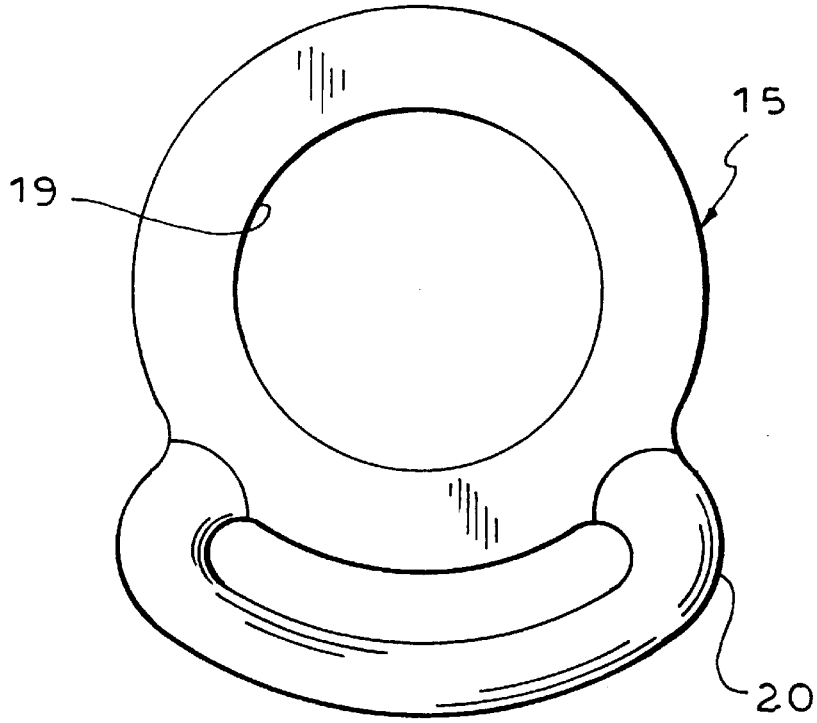
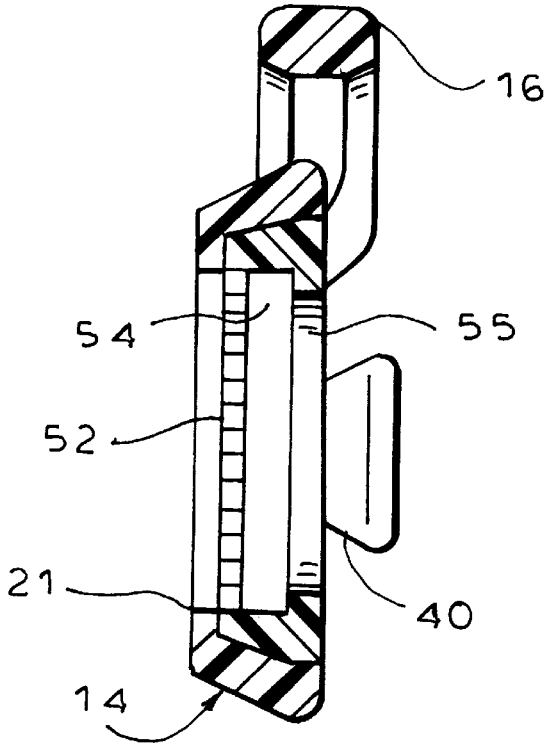
FIG. 17

GARMENT LINK

FIELD OF THE INVENTION

Our present invention relates to a garment link and, more particularly, to a garment link which can be attached to at last one strap and which can be utilized in brassieres, lingerie, bathing suits and indeed, any garment in which two strap portions are to be linked together or a strap is to be connected to some other garment part.

BACKGROUND OF THE INVENTION

Links with loops engageable by straps of a garment are utilized in lingerie and elsewhere to effect the connection between two strap portions or a strap portion and another garment part, usually with the strap portion being passed through the loop or to allow adjustment of the effective strap length and hence the manner in which the garment fits the individual.

The links provided heretofore for this purpose were scarcely aesthetic and frequently had limited versatility. Separability of parts of the link was usually not available and even where the link was small, it was frequently unsightly.

OBJECTS OF THE INVENTION

It is therefore an object of the present invention to provide an improved garment link which obviates the drawbacks mentioned previously.

More particularly, it is a specific object of the invention to provide a more aesthetic and versatile garment link which is more comfortable to use than earlier garment links, is more versatile with respect to association of the link with the garment and which is capable of offering additional functions.

Still another object of the invention is to provide an improved method of making a garment link and an improved garment provided with the garment link.

SUMMARY OF THE INVENTION

These objects and others which will become apparent hereinafter are attainable in a garment link, preferably a two loop garment link which has a pair of loops each engageable by a strap, in which the parts carrying the two loops can rotate at least limitedly with respect to one another and in which a central portion at least can be selected to suit aesthetic demands of a particular garment, enabling the central portion to be selected from a set of members of different function or appearance as will be described.

The invention is also applicable to a garment link for the purposes described having only a single loop and whose other side may be permanently affixed to a portion of the garment, e.g. by being welded thereto, stitched thereto or otherwise permanently attached.

According to a feature of the invention, the garment link can comprise:

an annular support;

a pair of loops on the support, each of the loops being configured to receive a respective strap; and a central member received in the annular support and visible from an obverse side of the link.

The support can include an annular member having a throughgoing hole and one of the loops can be fixed to the annular member and the other of the loops can be affixed to the front part of the support which can have a projection receivable in the annular member so that the two loops are interconnected by a push-button fit and can rotate at least limitedly relative to one another.

This alone creates a high degree of versatility for the link, since loops of different size and different styles may be used together in the link and the loops and the portions molded therewith can be of different texture or color as well.

The loops, for example, may be spanned by bars which subdivide the loops into windows above and below the bar and hence the opening of the loop may appear to be large but the loop can be capable of accommodating narrower or thinner straps as may be desirable.

The bars may be convex toward both of the windows delimited by them or can be concave toward one window and convex toward the other.

The invention is applicable as well to a link in which only one loop is provided and the snap connection between the loop-carrying member and a female part permanently affixed to the garment by stitching or welding, allows the interconnection of the two parts.

In any case, it has been found to be advantageous to provide an opening in the front part of the support which receives a selected one of a set of possible decorative and/or functional elements, referred to herein as "stones" utilizing the terminology of the fashion and jewelry trades, although the central element which is received in its "setting" in the front annular member need not be composed of mineral matter and indeed usually is composed of synthetic resin material.

According to the invention, the front annular member can be a setting for a jeweled element, i.e. one which is facetted or has the appearance of facets and/or a coloring element imparting a corresponding color to the center of the link as is present in one or the other of the loops or a contrasting coloration and/or a texturing element imparting a smooth, granular or fabric-like texture to the links and/or a planar element and/or a convex or concave element and/or a transparent or translucent element and/or a scent-releasing element and/or a light-emitting element.

For example, the stone set into the annular member may be colored or a clear reflective element in visible light but may contain photoluminescent material so that it can glow in the dark. It may have a diamond (jewelled) appearance or the appearance of a glass. The selected central member can be formed with the projection snap-fitted into the rear annular member.

According to an important feature of the invention, however, the stone set into the front annular member is a scent releasing container which may be referred to as a perfume stone. IN all cases, the stone is permanently emplaced in the annular member and may be ultrasonically welded thereto.

The perfume stone according to the invention advantageously has a cavity open toward its reverse side while its obverse side is defined by a wall of that cavity visible from the front or obverse of the link and pierced through by laser drilling with a multiplicity of capillary passages which communicate with the cavity. The rear of the cavity is closed, e.g. by a disk welded to the perfume container or the annular member receiving it and, according to the invention, once the cavity has been closed off by the disk, the unit, either the perfume stone itself or the perfume stone mounted on the link member carrying same, is immersed in a perfume liquid whereby the capillaries draw the liquid into the cavity and in use dispenses the scent through the capillaries over an extended period of time. The link may be recharged with perfume by application of a drop of perfume with a dropper on the perforated central surface.

The perfume stone itself has a utility apart from the links of the invention and may be mounted on garments other than by the loops mentioned previously.

According to a feature of the invention, the disk which is welded to the container is provided with the projection which enables the two parts of the link to be joined together by a snap or push-button connection in the manner described.

BRIEF DESCRIPTION OF THE DRAWING

The above and other objects, features, and advantages will become more readily apparent from the following description, reference being made to the accompanying drawing in which:

FIG. 3 is an elevational view of the rear member of the link whose hole is intended to accommodate the projection from the front member;

FIG. 17 shows the front member of the link assembled and in a cross sectional view;

SPECIFIC DESCRIPTION

Figure 2:
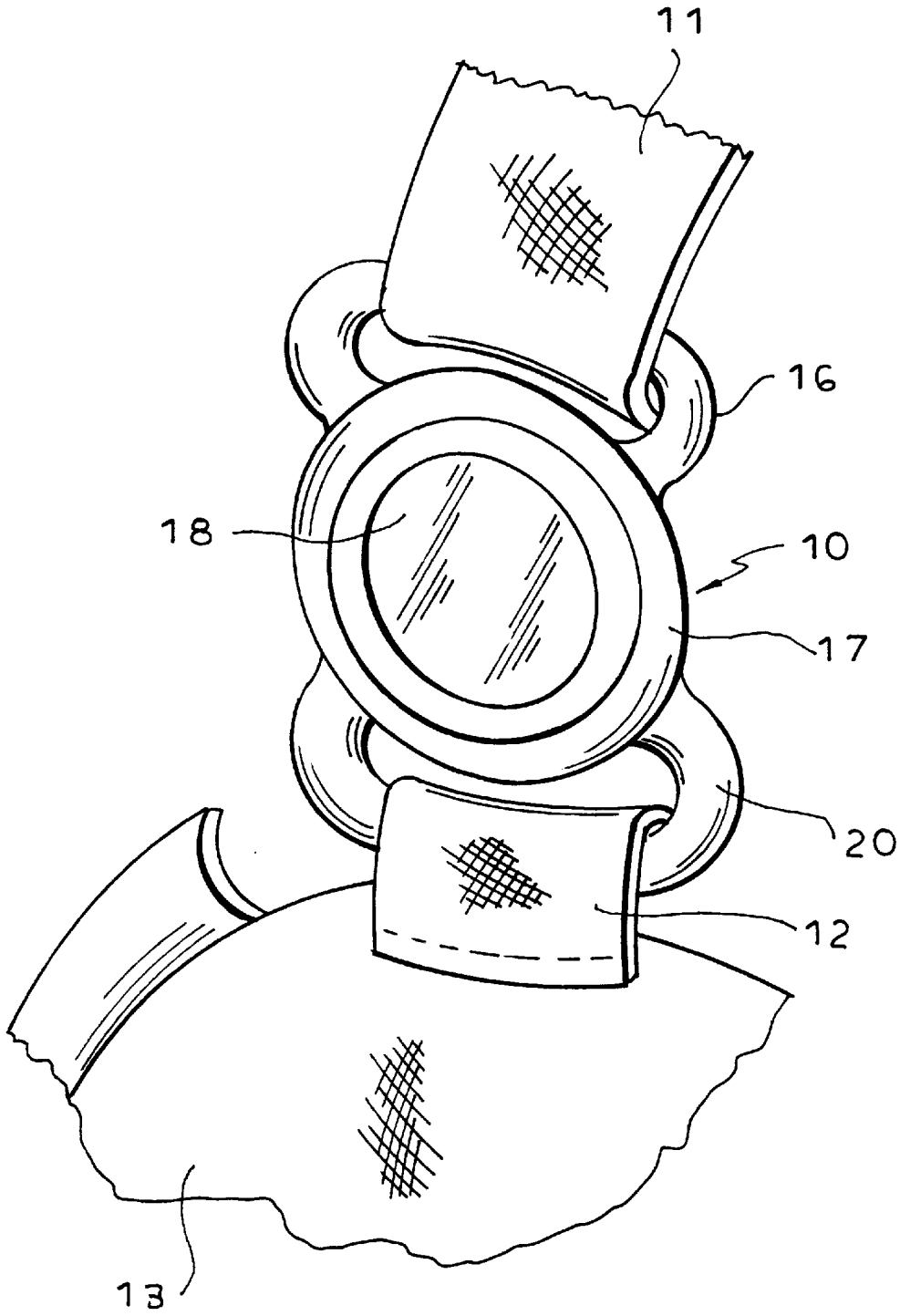
FIG. 2 is a perspective view showing the link in use in a brassiere but where the central member of the link is a reflective or mirror stone.
Figure 9:
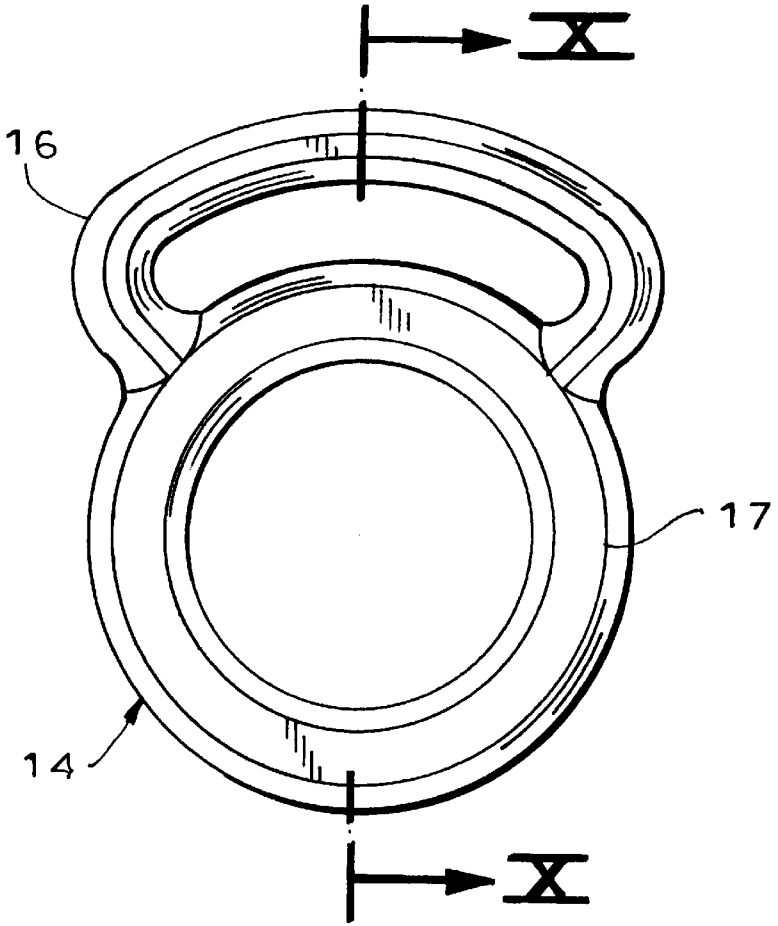
FIG. 9 is a front elevational view of the front member of the link.
Figure 11:
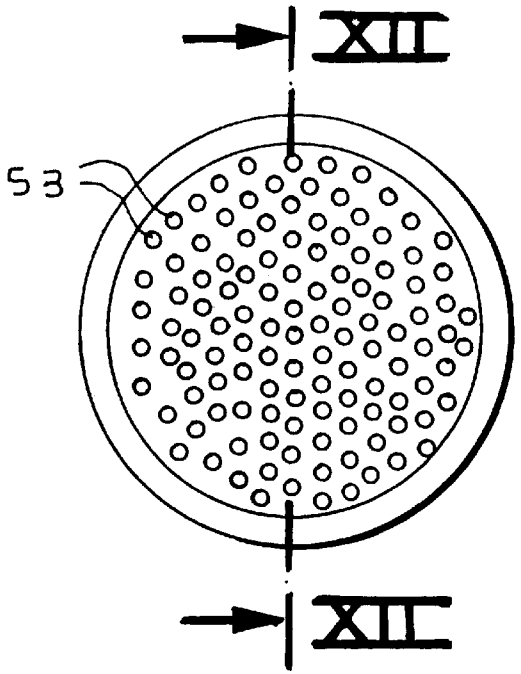
FIG. 11 is a front elevational view of the perfume stone.

In FIG. 2 of the drawing, the principle of the present invention can be seen immediately. In this Figure, a link 10 is provided between a pair of straps 11 and 12, the latter being stitched, for example, to a brassiere cup 13. The front member of the link 10, seen in elevational view in FIG. 9, has been represented at 14 and the rear member seen in elevation in FIG. 3 has been represented at 15 in the drawing. The two connected annuluses of the front and rear members form the "support" for the loops. It will be apparent that the front member 14 has a loop 16 and an annular seat 17 which receives a stone 18 provided with a projection which can engage in a hole 19 in the rear member 15. The latter also has a loop as shown at 20 in FIGS. 2 and 3.

The stone 18 is a reflective stone or mirror in the embodiment shown in FIG. 2.

Figure 1:
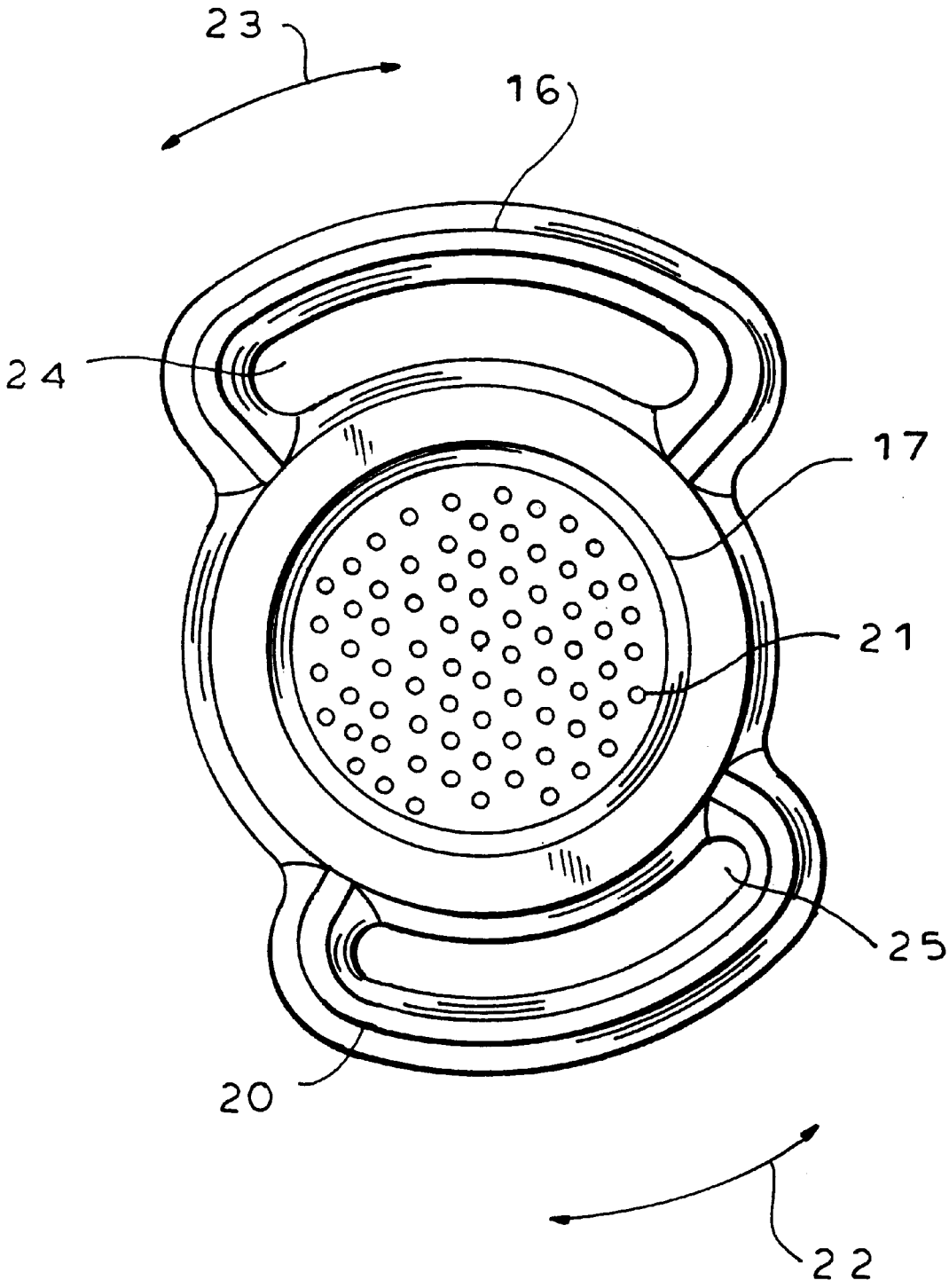
FIG. 1 is a front elevational view of a link according to the invention provided with a perfume stone.

As can be seen from FIG. 1, however, the central ornament or stone 21 received in the annular seat 17 can be a microperforated member which is referred to herein as a perfume stone. The loops 16 and 20 are also visible in FIG. 1 and it will be apparent that, by reason of the push-button connection of the front and rear parts, the loops can swing relative to one another as represented by the arrows 22 and 23. Furthermore, because the loops 16 and 20 are on two separate press-fitted parts, the link 10 can be assembled from front and rear parts with different size and style loops and, of course, different color loops.

In the embodiments of FIGS. 1–17, the loops are simply arcuate loops with crescent-shaped openings 24 and 25 to receive the straps.

Figure 21:
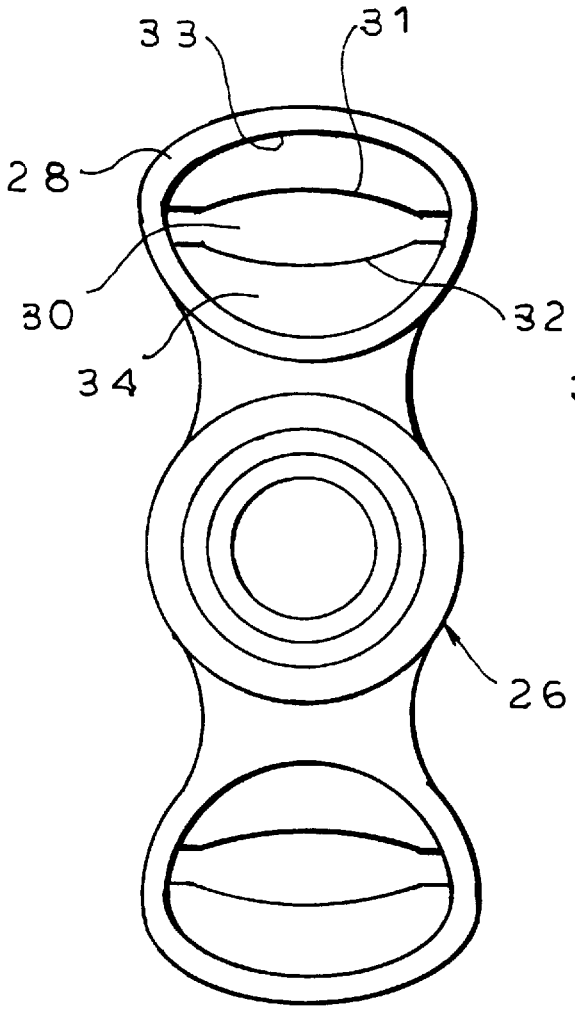
FIGS. 21 and 22 are elevational views of links showing different loop configurations which can be utilized with any of the links otherwise described herein.
Figure 22:
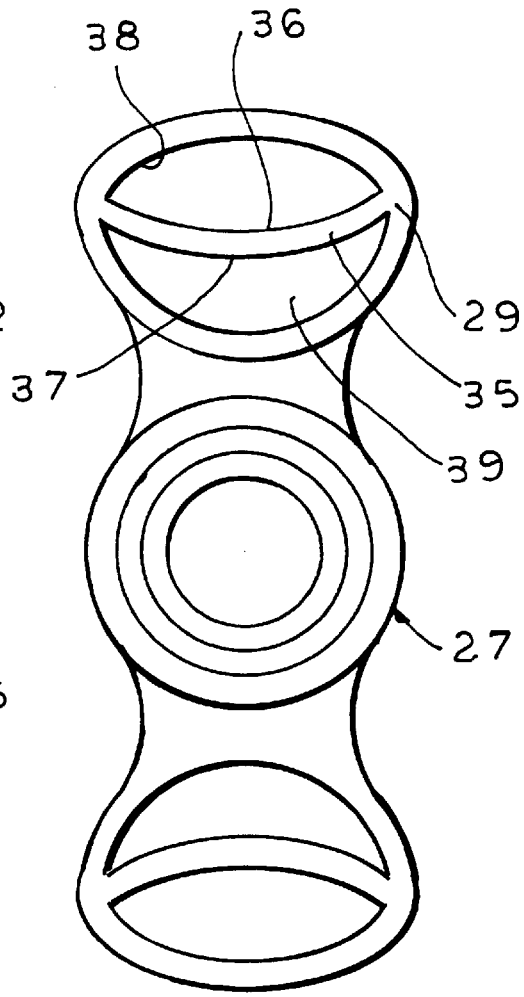

However, in the links 26 and 27 of FIGS. 21 and 22, the loops 28 and 29 are configured quite differently and generally have the shape of shields. In FIG. 21, for example, the loop 28 is spanned by a bar 30 having convex edges 31 and 32 delimiting the windows 33 and 34 on opposite sides of the bar.

In FIG. 22, however, the shield-shaped loop 29 has a bar 35 extending across its opening and formed with a concave edge 36 and a convex edge 37 delimiting the openings 38 and 39, respectively. In the embodiment of FIGS. 21 and 22, the annular seat 17 can receive a projecting boss surrounding the opening 19 of the inner member to allow the parts to be press-fitted together or can have the boss which is press-fitted into the opening 19. In this case no central stone is provided.

Figure 4:
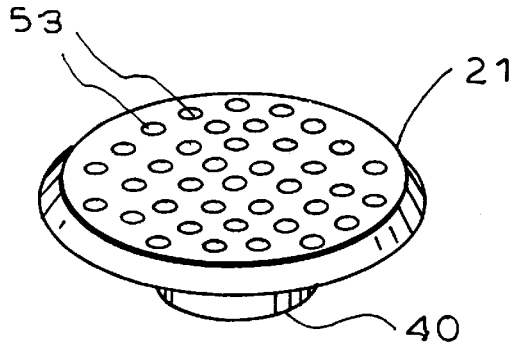
FIGS. 4–7 are perspective views of various stones which can be selectively set in the annular seat of the front member of the link.
Figure 5:
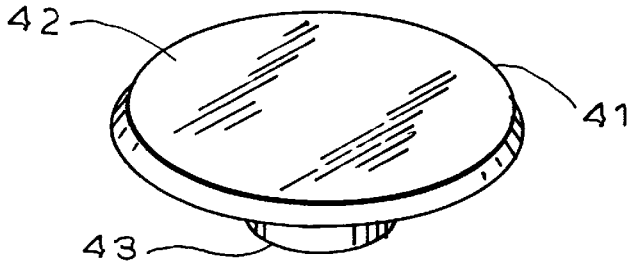

As can be seen from FIGS. 4–8, a variety of central stones may be used. For example, FIG. 4 shows the perfume stone 21 with its projection 40 on its rear side. FIG. 5, however, shows a glass insert 41 with a planar surface 42 and colored to contrast with or match the setting 17. The stone 41 likewise has a projection 43 on its rear face.

Figure 6:
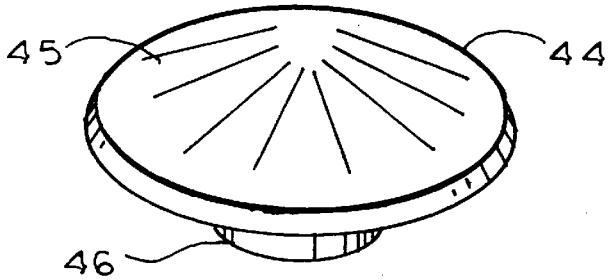

The stone 44 of FIG. 6 which can alternatively be received in the seat 17, can be facetted at 45 to have the appearance of a diamond or other jewel and likewise has a projection 46 extending rearwardly.

Figure 7:
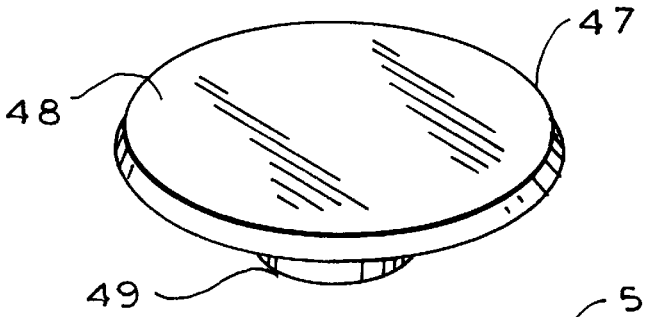

The stone 47 of FIG. 7 has a textured surface 41, can be any desired color and can be even concave outwardly. It too has a central projection 49. The stones are welded in place in the seat 17 so that their central projections 40, 43, 46 and 49 can snap into the opening 19 of the rear member 15 of the link.

Figure 8:
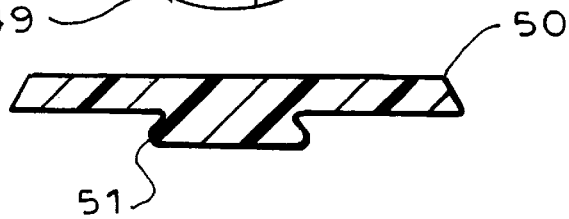
FIG. 8 is a cross sectional view of a luminescent stone for use in the link.

From FIG. 8, it can be seen that a stone 50 can be molded unitarily with the projection 51, can be composed of plastic and in the embodiment illustrated can contain a photoluminescence or can be constituted of a glow-in-the-dark plastic if desired.

In FIG. 17 we have shown the member 14 provided with the loop 16 and with the perfume stone 21 in place. The perfume stone 21 is a perfume container with a wall 52 microperforated by laser drilling so as to have a multiplicity of capillaries 53 communicating with a cavity 54. The latter is closed by a disk 55 which is formed with the projection 40 engageable in a snap fit in the opening 19.

Figure 12:
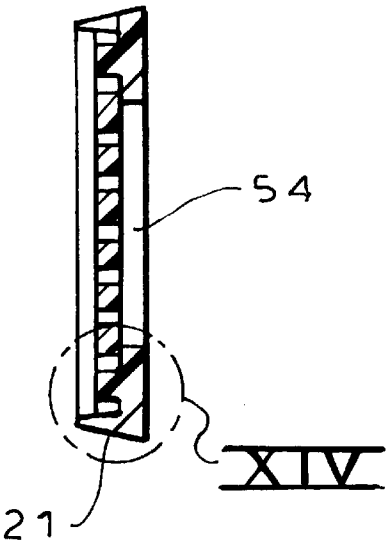
FIG. 12 is a cross sectional view along the line XII—XII of FIG. 11.
Figure 13:
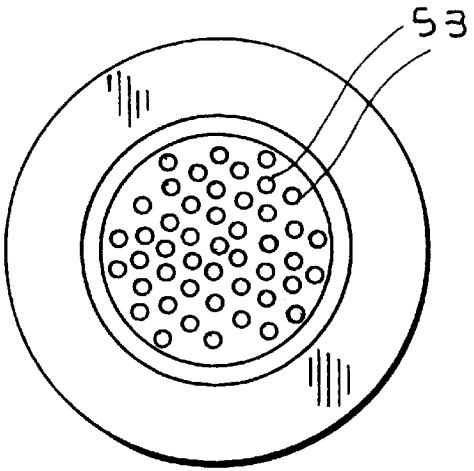
FIG. 13 is a rear view of the perfume stone with the disk omitted.
Figure 14:
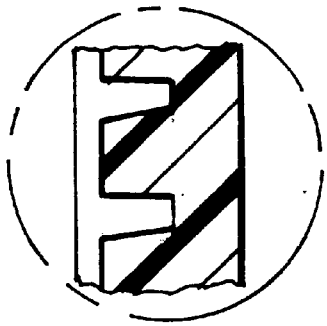
FIG. 14 is a detail of the region XIV of FIG. 12.
Figure 15:
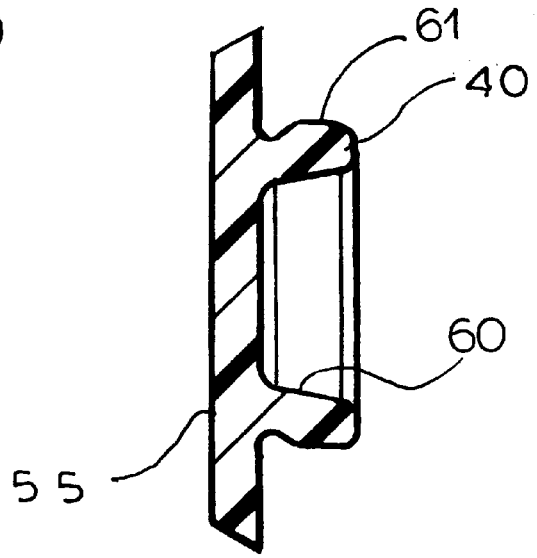
FIG. 15 is a cross sectional view through that disk.
Figure 16:
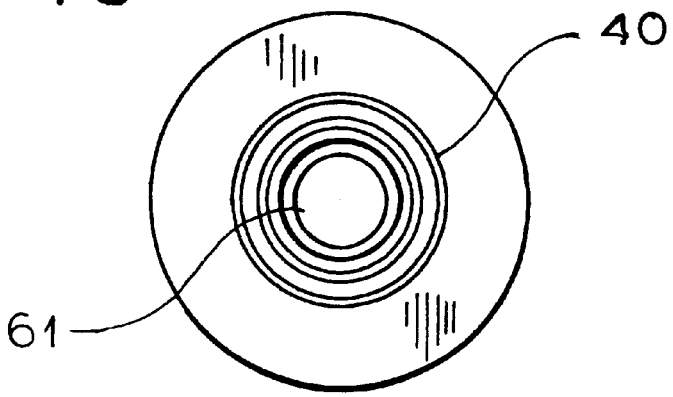
FIG. 16 is a rear elevational view of the disk.

For this purpose, the seat 17 (FIG. 10) has an overhang 56 surrounding the opening 57 and is shaped to snugly receive the perfume container 21 (see FIG. 12). The capillaries are visible at 53 in both FIGS. 11 and 13 and can be seen, in FIG. 12, to communicate with the cavity 54. The latter is closed by a disk 55 which is formed with the projection 40 engageable in a snap fit in the opening 19.

For this purpose, the seat 17 (FIG. 10) has an overhang 56 surrounding the opening 57 and is shaped to snugly receive the perfume container 21 (see FIG. 12). The capillaries are visible at 53 in both FIGS. 11 and 13 and can be seen, in FIG. 12, to communicate with the cavity 54.

Figure 10:
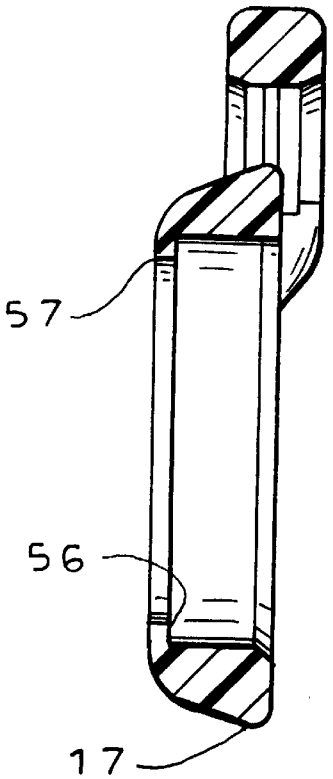
FIG. 10 is a cross sectional view taken along the line X—X of FIG. 9.

The disk 55 has been shown in FIG. 10 and is seen to be unitarily molded with the projection 40 which is cup-shaped and therefore hollow at 60 while being formed with a bulge 61.

The perfume container is inserted into the link half 14 and the cover disk 54 is applied and welded to the seat 17 and to the container 21. When the container is immersed in a perfume liquid, capillary action draws the perfume into the cavity 54 and after the perfume is shaken off and the link is dried, scent is released into the air from the garment over a substantial period of time. Recharging with perfume is also possible in the manner described. The heat of the body serves to assist in vaporizing the liquid in the cavity.

Figure 18:
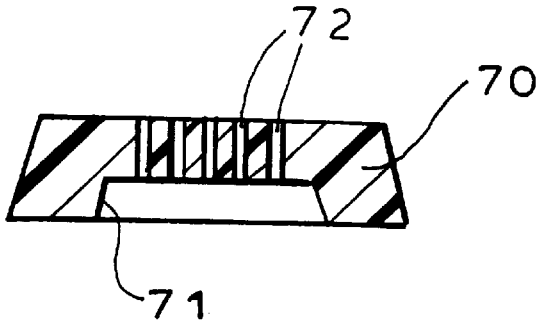
FIGS. 18, 19 and 20 are sectional views showing the assembly of a perfume member apart from a link according to the invention.
Figure 19:
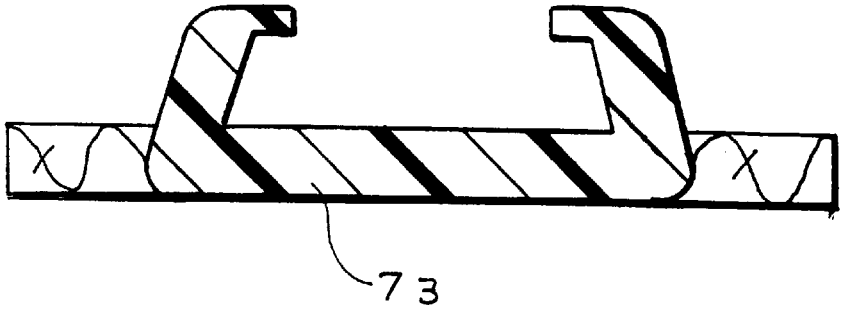
Figure 20:
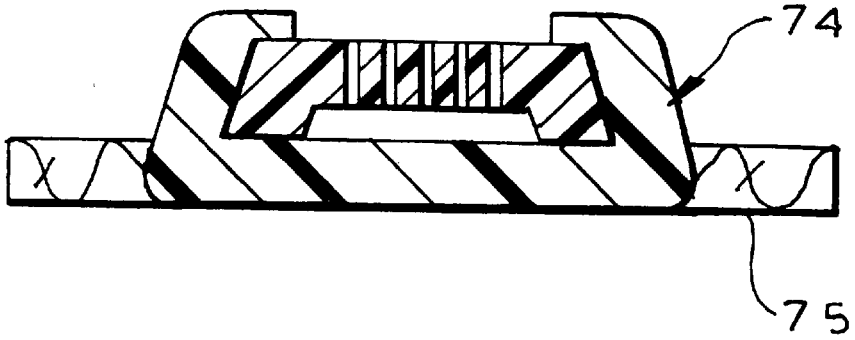

FIGS. 18–20 show that a container 70 having a cavity 71 and a perforated region 72 can be received in a seat 73 and locked in place so that it can be retained by the support as shown in FIG. 20. The resulting perfume stone 74 can be provided with fabric 75 or otherwise bonded to some support for attachment to a garment.

We claim:

1. A garment link comprising:

an annular support;

a pair of loops on said support, each of said loops being configured to receive a respective strap; and a central member received in said annular support and visible from an obverse side of said link, said central member comprising a perfume container, said perfume container being formed with a cavity opening toward the reverse side of said link, and with a wall provided with a multiplicity of capillary openings communicating with said cavity on an obverse side of said container, and a disk closing said cavity on said reverse side of said container.

2. The garment link defined in claim 1 wherein said disk is welded to said container and is formed with a projection snap-fitted in said support.

3. The garment link defined in claim 2 wherein said projection has an outwardly convex bulge engaging in said support.

4. The garment link defined in claim 3 wherein said capillaries are formed by laser drilling of a wall of said container.

5. The garment link defined in claim 4 wherein said central member is provided with a recess receiving said container and said disk.

6. A garment link comprising:

at least one loop adapted to receive a respective strap of a garment;

an annular member having a throughgoing hole connected to said loop;

a perfume container received in said annular member and formed with a cavity opening toward a rear of said link for receiving perfume, said perfume container having a wall between said cavity and an obverse side of said perfume container pierced by a multiplicity of laser-drilled capillaries extending to said cavity; and a disk on said reverse side of said link closing said cavity, said perfume container being received in a recess formed in said annular member and said disk is welded to said annular member to seal said perfume container therein and close said cavity.

7. The garment link defined in claim 6 wherein said disk is formed with a push button receivable in a female member adapted to be secured to said garment.

8. A method of forming a garment link which comprises the steps of:

providing an annular member having a throughgoing hole and formed with at least one loop receiving a respective strap;

fitting a perfume container having a rearwardly open cavity and a wall communicating with said cavity and a laser pierced with a multiplicity of throughgoing capillaries;

sealing said cavity along a reverse side of said link with a disk;

immersing said container in a liquid scent whereby said liquid scent is drawn through said capillaries into said cavity; and affixing said link to a garment at least in part by a strap through said loop whereby scent is emitted from liquid in said cavity through said capillaries as said garment is worn by the user, said disk being provided with a projection, said link being affixed to said garment at least in part by press-fitting said projection into a female link portion adapted to be secured to said garment.

* * * * *